US011473184B2

(12) United States Patent
Nishida

(10) Patent No.: US 11,473,184 B2
(45) Date of Patent: Oct. 18, 2022

(54) METHOD FOR MANUFACTURING METAL RING LAMINATE

(71) Applicant: TOYOTA JIDOSHA KABUSHIKI KAISHA, Toyota (JP)

(72) Inventor: Koji Nishida, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 67 days.

(21) Appl. No.: 17/123,790

(22) Filed: Dec. 16, 2020

(65) Prior Publication Data

US 2021/0246540 A1 Aug. 12, 2021

(30) Foreign Application Priority Data

Feb. 12, 2020 (JP) ..... JP2020-021463

(51) Int. Cl.

| | |
|---|---|
| ***C23C 8/26*** | (2006.01) |
| ***C21D 9/40*** | (2006.01) |
| ***C23C 8/14*** | (2006.01) |

(52) U.S. Cl.

CPC ..... *C23C 8/26* (2013.01); *C21D 9/40* (2013.01); *C23C 8/14* (2013.01)

(58) Field of Classification Search

CPC ..... C23C 8/26; C23C 8/14; C21D 9/40

See application file for complete search history.

(56) References Cited

U.S. PATENT DOCUMENTS

2016/0059288 A1* 3/2016 Koga ..... F16G 5/16 134/115 R
2016/0290437 A1* 10/2016 Serizawa ..... C23C 8/02

FOREIGN PATENT DOCUMENTS

| | | | |
|---|---|---|---|
| CN | 106051046 | A | 10/2016 |
| JP | 2004-43962 | A | 2/2004 |
| JP | 2016-505092 | A | 2/2016 |
| WO | 2014/102214 | A1 | 7/2014 |

* cited by examiner

*Primary Examiner* — Jessee R Roe
(74) *Attorney, Agent, or Firm* — Oliff PLC

(57) ABSTRACT

A method for manufacturing a metal ring laminate includes: performing an aging treatment on a metal ring laminate in which a plurality of metal rings made of maraging steel are laminated; and performing a nitriding treatment on the metal ring laminate that has been nitrided. Oxidizing treatment is performed after the aging treatment but before the nitriding treatment at a temperature equal to or higher than 350° C. and lower than an aging treatment temperature.

3 Claims, 11 Drawing Sheets

METHOD FOR MANUFACTURING METAL RING LAMINATE

CROSS REFERENCE TO RELATED APPLICATIONS

This application is based upon and claims the benefit of priority from Japanese patent application No. 2020-021463, filed on Feb. 12, 2020, the disclosure of which is incorporated herein in its entirety by reference.

BACKGROUND

The present disclosure relates to a method for manufacturing a metal ring laminate.

A continuously variable transmission (CVT) of a steel belt-type in which an input-side pulley and an output-side pulley are connected to each other by a steel transmission belt is used in, for instance, automobiles. The transmission belt of the steel belt-type CVT has a structure in which a plurality of elements that are aligned without any gaps therebetween are attached to a metal ring laminate formed of a plurality of thin metal rings laminated in a nested manner. The elements are pressed against the input-side pulley and the output-side pulley by the tensile stress of the metal ring laminate, and therefore power is transmitted from the input-side pulley to the output-side pulley.

In order to ensure frictional force between the elements and the input-side and the output-side pulleys, high tensile stress is applied to each metal ring forming the metal ring laminate. Therefore, maraging steel, which is ultra-high strength steel hardened by precipitation, is used for the metal rings. Further, repeated flexural stress is applied to the metal rings under a high tensile stress state. Therefore, in order to enhance the fatigue strength, a nitriding treatment for imparting compressive residual stress to the surface of the metal rings is performed.

In general, the nitriding treatment is performed on each of the plurality of the metal rings, and then the plurality of the nitrided metal rings are laminated. Accordingly, there has been a problem that the size of the nitriding treatment apparatus becomes large. Published Japanese Translation of PCT International Publication for Patent Application, No. 2016-505092 discloses a technique in which a plurality of metal rings are laminated to form the metal ring laminate described above and then a nitriding treatment is performed on the metal ring laminate.

SUMMARY

The inventors have found the following problem as regards a method for manufacturing a metal ring laminate in which an aging treatment is performed on the metal ring laminate obtained by laminating a plurality of metal rings made of maraging steel and then a nitriding treatment is performed on the metal ring laminate.

As disclosed in Published Japanese Translation of PCT International Publication for Patent Application, No. 2016-505092, when the nitriding treatment is performed on the metal ring laminate, hardly any nitrogen gas such as ammonia enters the metal rings disposed in the middle of the metal ring laminate, and thus these metal rings are hardly nitrided. Therefore, there has been a problem that the difference between the surface hardness of the metal rings disposed on the surface side of the metal ring laminate and the surface hardness of the metal rings disposed in the middle of the metal ring laminate becomes large.

The present disclosure has been made in view of the problem mentioned above, and the present disclosure is to make the difference between the surface hardness of the metal rings disposed on the surface side of the metal ring laminate and the surface hardness of the metal rings disposed in the middle of the metal ring laminate small while maintaining a desired strength of the metal rings.

A method for manufacturing a metal ring laminate according to an aspect of the present disclosure includes:

performing an aging treatment on a metal ring laminate in which a plurality of metal rings made of maraging steel are laminated; and performing a nitriding treatment on the metal ring laminate on which the aging treatment has been performed, in which an oxidizing treatment is performed after the aging treatment but before the nitriding treatment at a temperature equal to or higher than 350° C. and lower than an aging treatment temperature.

In the method for manufacturing the metal ring laminate according to the aforementioned aspect of the present disclosure, the oxidizing treatment is performed on the metal ring laminate after the aging treatment but before the nitriding treatment at a temperature equal to or higher than 350° C. and equal to or lower than an aging treatment temperature. Therefore, the difference between the surface hardness of the metal rings disposed on the surface side of the metal ring laminate and the surface hardness of the metal rings disposed in the middle of the metal ring laminate can be made small while maintaining a desired strength of the metal rings.

The aging treatment temperature may fall in a range of 450° C. to 500° C. In addition, the metal ring laminate may be used for a transmission belt of a continuously variable transmission.

According to the present disclosure, the difference between the surface hardness of the metal rings disposed on the surface side of the metal ring laminate and the surface hardness of the metal rings disposed in the middle of the metal ring laminate can be made small while maintaining a desired strength of the metal rings.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

Hereinafter, the present disclosure will be described through specific embodiments to which the present disclosure is applied with reference to the drawings. However, the present disclosure is not to be limited to the embodiments described below. Note that the following description and the attached drawings are appropriately shortened and simplified where appropriate to clarify the explanation.

First Embodiment

<Structure of Metal Ring>

Figure 1:
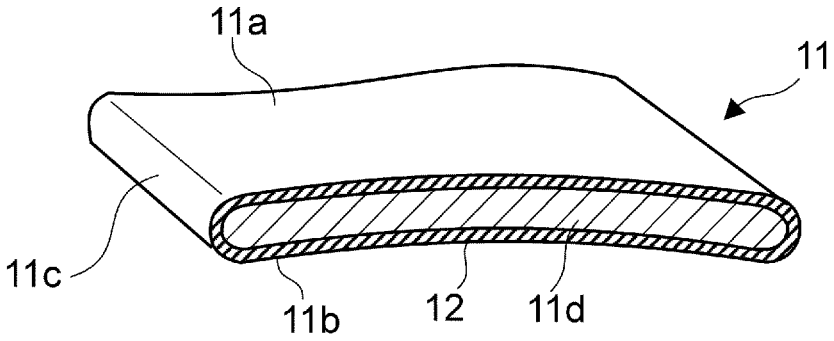
FIG. 1 is a perspective cross sectional diagram of a metal ring that forms a metal ring laminate manufactured by a method for manufacturing a metal ring laminate according to a first embodiment.

First, a metal ring that constitutes a metal ring laminate manufactured by a method for manufacturing a metal ring laminate according to a first embodiment is described with reference to FIG. 1. FIG. 1 is a perspective cross sectional diagram of a metal ring that constitutes the metal ring laminate manufactured by the method for manufacturing the metal ring laminate according to the first embodiment.

The metal ring 11 is a belt-like thin plate member made of maraging steel. The metal ring 11 has a thickness of, for example, around 0.150 mm to 0.200 mm, and a width of, for example, around 10 mm. As shown in FIG. 1, the metal ring 11 has a nitrided layer 12 on its surface, that is, on an outer circumferential surface 11*a*, an inner circumferential surface 11*b*, and an end surface 11*c* of both the outer and the inner circumferential surfaces 11*a* and 11*b*, when viewed in cross-section. In other words, a whole outer periphery of a non-nitrided part 11*d* which is a bulk is surrounded by the nitrided layer 12.

Note that the metal ring 11 is gently curved such that a widthwise center part thereof protrudes slightly more toward the outer circumferential surface 11*a* side compared to both widthwise end parts thereof.

The metal ring 11 is made of maraging steel. The maraging steel is a ultra-high strength steel hardened by precipitation and having a carbon concentration equal to or lower than 0.03% by mass and doped with, for instance, nickel (Ni), cobalt (Co), molybdenum (Mo), titanium (Ti), and aluminum (Al), and can exhibit high strength and toughness when the aging treatment is performed. The composition of the maraging steel is, for example, 17% to 19% by mass of Ni, 7% to 13% by mass of Co, 3% to 6% by mass of Mo, 0.3% to 1.0% by mass of Ti, and 0.05% to 0.15% by mass of Al, the rest of the parts of the composition being Fe and inevitable impurities. Further, small amounts of, for instance, Cr and Cu may also be contained in the composition.

To be more specific, as described later with reference to FIGS. 2 and 3, a plurality (for example, around 10) of the metal rings 11 that differ slightly in their respective perimeters are laminated in a nested manner to form the metal ring laminate 10.

<Configuration of Belt-Type Continuously Variable Transmission to which Metal Ring is Applied>

Next, a belt-type continuously variable transmission 1 that employs the metal ring laminate manufactured by the method for manufacturing the metal ring laminate according to the first embodiment is described with reference to FIGS. 2 and 3. FIG. 2 is a sectional diagram of the belt-type continuously variable transmission to which the metal ring laminate manufactured by the method for manufacturing the metal ring laminate according to the first embodiment is applied. FIG. 3 is a side view of the belt-type continuously variable transmission to which the metal ring laminate manufactured by the method for manufacturing the metal ring laminate according to the first embodiment is applied.

Figure 2:
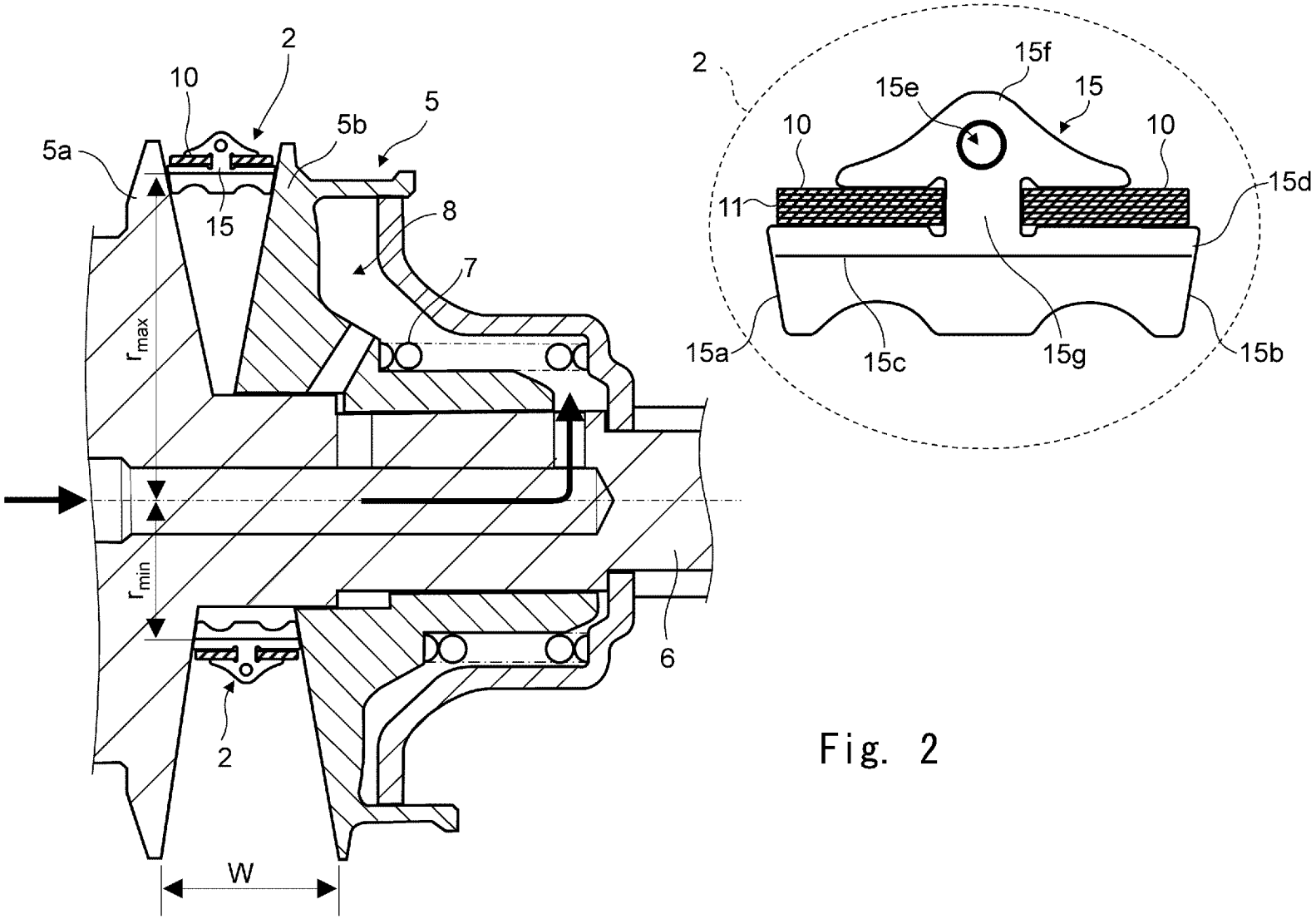
FIG. 2 is a cross sectional diagram of a belt-type continuously variable transmission to which the metal ring laminate manufactured by the method for manufacturing the metal ring laminate according to the first embodiment is applied.
Figure 3:
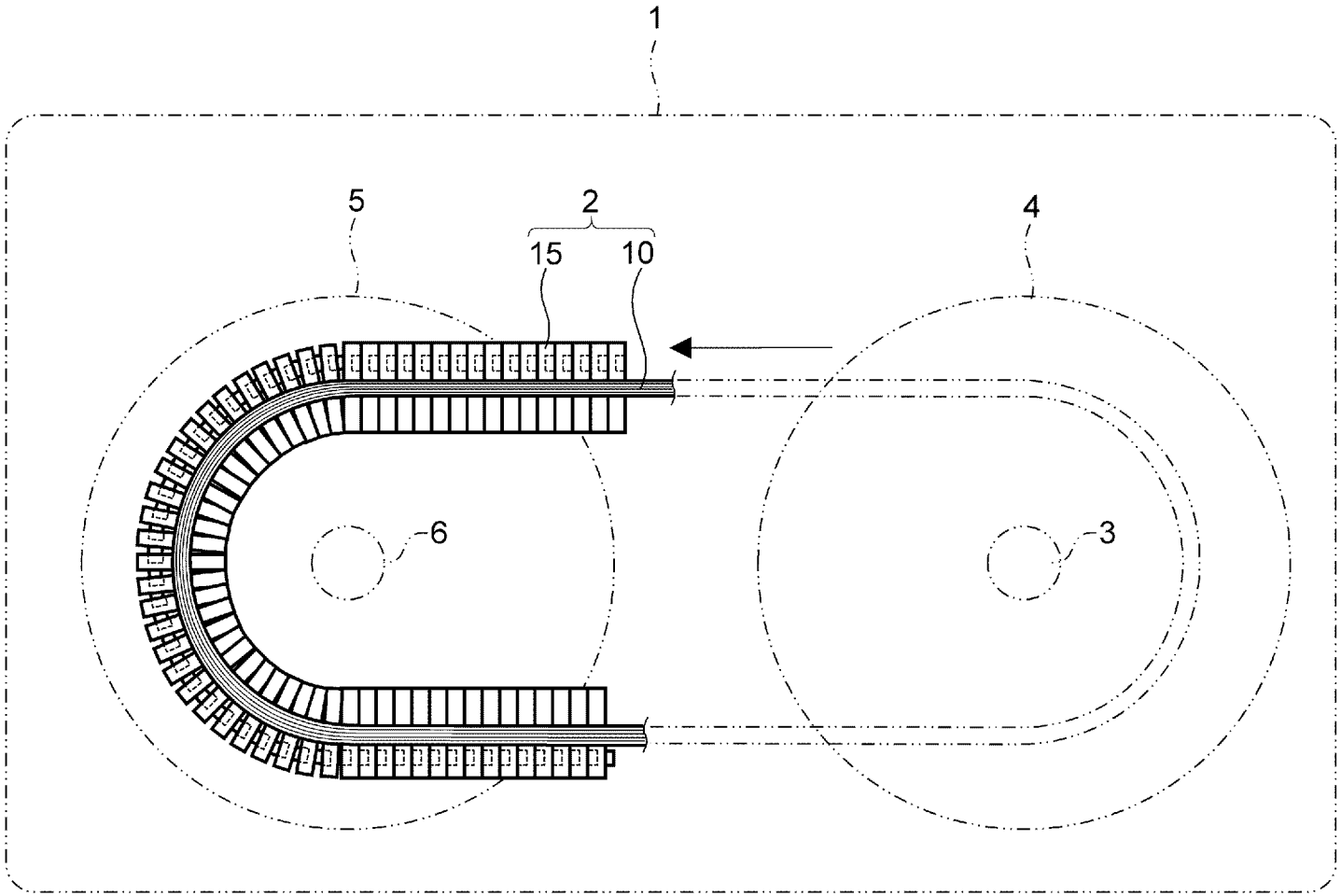
FIG. 3 is a side view of the belt-type continuously variable transmission to which the metal ring laminate manufactured by the method for manufacturing the metal ring laminate according to the first embodiment is applied.

As shown in FIGS. 2 and 3, by laminating the plurality of metal rings 11 that differ slightly in their respective perimeters in a nested manner, a pair of metal ring laminates 10 are formed. As shown in FIG. 3, many (for example, around 400) elements 15 that are aligned without any gaps therebetween are attached to the pair of metal ring laminates 10 whereby the transmission belt 2 is configured. Here, the thickness direction of the elements 15 coincides with the circumferential direction of the metal ring laminates 10.

An enlarged diagram of the transmission belt 2 is shown in a circle indicated by the dashed lines in FIG. 2. As shown in the enlarged diagram of FIG. 2, the element 15 includes a body part 15*d*, a head part 15*f*, and a neck part 15*g* connecting the body part 15*d* and the head part 15*f* at the widthwise center part thereof. The body part 15*d* includes end surface parts 15*a* and 15*b* that engage with the input-side pulley 4 and the output-side pulley 5, respectively, and a locking edge part 15*c*. A recessed-and-projected engagement part 15*e*, in which the recessed part and the projected part are engaged with each other in a laminated direction, is formed in the head part 15*f*. Further, on both sides of the neck part 15*g*, a pair of the metal ring laminates 10 is inserted between the body part 15*d* and the head part 15*f*.

As shown in FIG. 3, the transmission belt 2 configured of the metal ring laminates 10 and the plurality of elements 15 is wound around the input-side pulley 4 and the output-side pulley 5. At the two curved sections of the transmission belt 2, the elements 15 are pressed against the input-side pulley 4 and the output-side pulley 5 by the tensile stress of the metal ring laminates 10. Therefore, power can be transmitted from the input-side pulley 4 to the output-side pulley 5.

Here, as shown in FIG. 3, the belt-type continuously variable transmission 1 includes the input-side pulley 4 connected to an input shaft 3, the output-side pulley 5 connected to an output shaft 6, and the transmission belt 2 wound between the input-side pulley 4 and the output-side pulley 5 for transmitting power. With this belt-type continuously variable transmission 1, power is input from an engine of a vehicle, which is not illustrated, to the input shaft 3 through a clutch or a torque convertor. Meanwhile, power is input from the output shaft 6 to right and left driving wheels through a reduction gear mechanism and a differential gear mechanism, which are not illustrated.

As shown in FIG. 2, the output-side pulley 5 includes a fixed-side sheave member 5*a* fixed to the output shaft 6 and a moveable-side sheave member 5*b* supported by the output shaft 6 in an axially displaceable manner. A roughly V-shaped groove is formed between the fixed-side sheave member 5*a* and the moveable-side sheave member 5*b*, and a groove width W can be changed. A compression coil spring 7 and a hydraulic actuator 8 are attached to the input-side pulley 5.

The compression coil spring 7 energizes the moveable-side sheave member 5*b* in a downshifting direction which is a direction toward which the groove width W of the output-side pulley 5 is reduced.

The hydraulic actuator 8 displaces the moveable-side sheave member 5*b* in the axial direction by causing hydraulic pressure to act on a back side of the moveable sheave member 5*b*.

By this configuration, a winding radius r of the transmission belt 2 with respect to the output-side pulley 5 can be varied within a range of the minimum radius rmin to the maximum radius rmax.

Note that except that an energizing member such as the compression coil spring 7 is not included in the input-side pulley 4 while it is included in the output-side pulley 5, the input-side pulley 4 and the output-side pulley 5 have substantially the same configuration. Although not illustrated in detail, the input-side pulley 4 includes the fixed-side sheave member fixed to the input shaft 3 and the moveable-side sheave member supported by the input shaft 3 in a moveable manner in the axial direction so as to form a roughly V-shaped groove with the fixed-side sheave member. The input-side pulley 4 further includes a hydraulic actuator that is capable of energizing the moveable-side sheave member in an upshifting direction.

<Method for Manufacturing Metal Ring>

Figure 4:
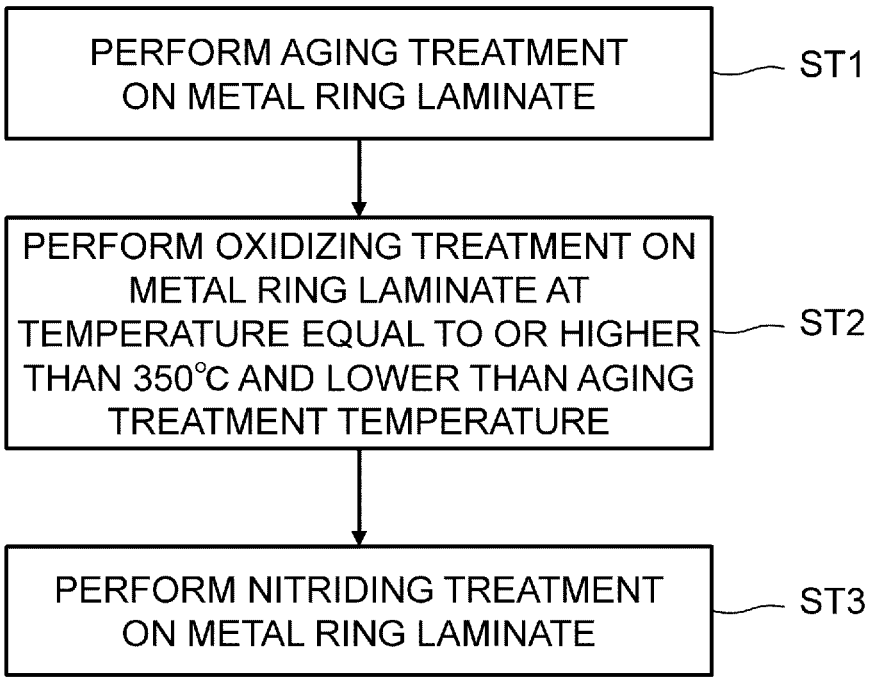
FIG. 4 is a flowchart showing the method for manufacturing the metal ring laminate according to the first embodiment.
Figure 5:
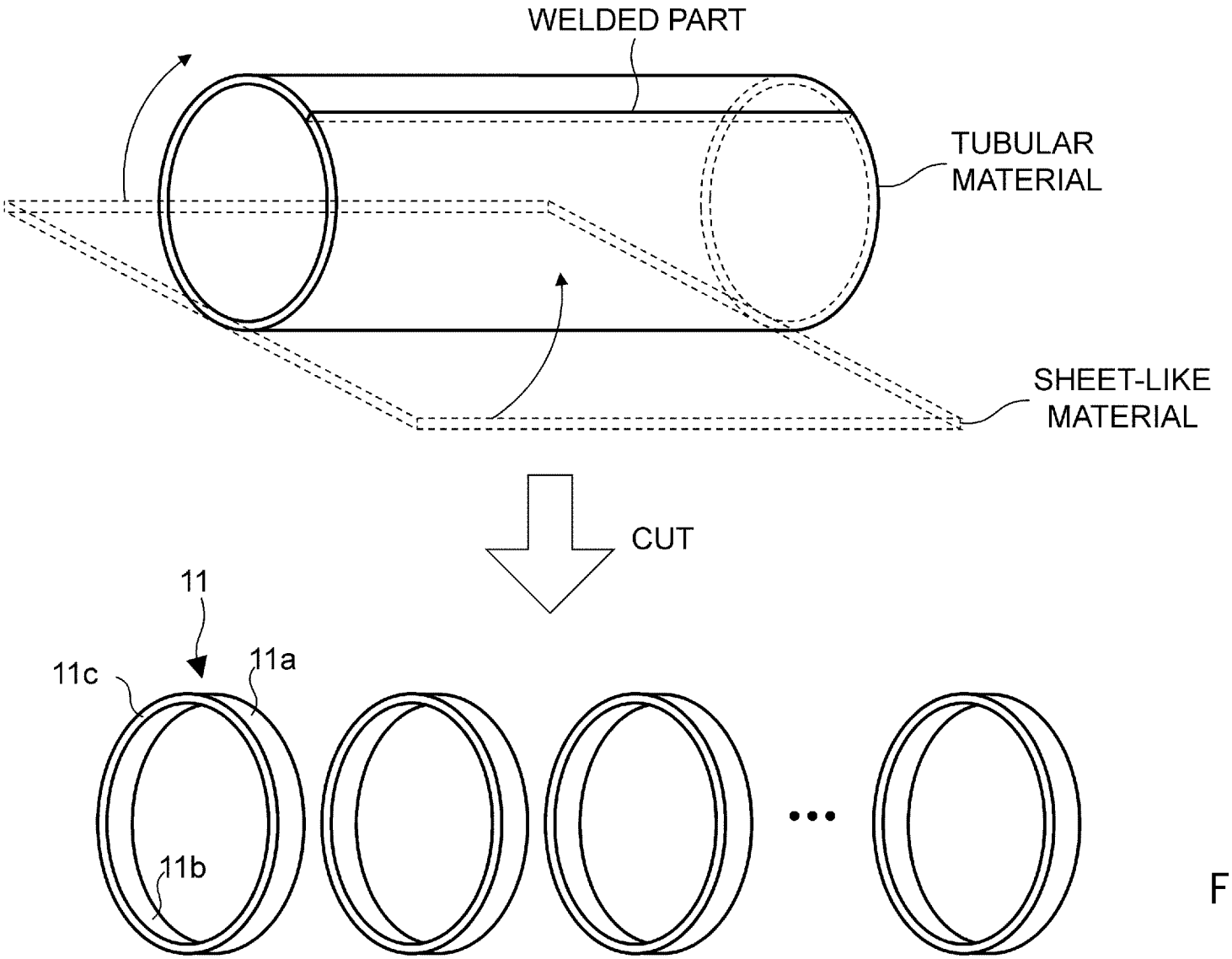
FIG. 5 is a perspective diagram showing the method for manufacturing the metal ring laminate according to the first embodiment.

Next, the method for manufacturing the metal ring laminate according to the first embodiment is described with reference to FIGS. 4 and 5. FIG. 4 is a flowchart showing a method for manufacturing the metal ring laminate according to the first embodiment. FIG. 5 is a perspective diagram showing the method for manufacturing the metal ring laminate according to the first embodiment.

Prior to performing the steps shown in FIG. 4, the process described below, for instance, is performed.

First, as shown in the upper half of FIG. 5, a sheet-like material is formed into a cylindrical shape and end surfaces thereof are welded, whereby a tubular material is produced. Needless to say, the tubular material is not limited to a welded tube like the one described above and may be a seamless tube.

Next, as shown in the lower half of FIG. 5, after the tubular material is welded, a metal ring 11 is cut out from the tubular material.

Next, although not illustrated, the thickness of the metal ring 11 is reduced to a prescribed value and the perimeter thereof is lengthened to a prescribed length.

Then, in order to remove distortion, annealing is performed in a nitrogen atmosphere or a reducing atmosphere at a temperature around 800° C. to 900° C. for about 5 to 30 minutes.

Further, tensile stress is applied to the sintered metal ring 11 so that the perimeter of the metal ring is precisely adjusted to the prescribed length thereof, and then a plurality of the metal rings 11 are laminated to form the metal ring laminate 10.

Thereafter, the steps shown in FIG. 4 are performed.

First, as shown in FIG. 4, the aging treatment is performed on the metal ring laminate 10 (Step ST1). The aging treatment is performed, for example, in a nitrogen atmosphere or a reducing atmosphere at a temperature around 450° C. to 500° C. for about 90 to 180 minutes.

Next, the oxidizing treatment is performed on the metal ring laminate 10 (Step ST2). The oxidizing treatment is a pretreatment process for promoting the nitriding treatment. The oxidizing treatment is performed at a temperature equal to or higher than 350° C. and equal to or lower than the aging treatment temperature. The oxidizing treatment time is, for example, 15 to 60 minutes. Details of the oxidizing treatment temperature are described later.

Finally, the nitriding treatment is performed on the metal ring laminate 10 (Step ST3). The nitriding treatment is performed, for example, under an atmosphere of 5% to 15% by volume of ammonia gas, 1% to 3% by volume of hydrogen gas, and the rest being nitrogen gas, at a temperature of around 400° C. to 450° C. for about 40 to 120 minutes.

Note that the hydrogen gas contained within the atmosphere is generated by pyrolysis reaction of ammonia gas shown below.

$$2NH_3 \rightarrow 2(N)+3H_2$$

Here, (N) denotes nitrogen atoms that are generated due to contact with the surface of the metal ring 11. Due to entry of these nitrogen atoms inside the metal ring 11, nitride is generated, and the nitrided layer 12 shown in FIG. 1 is formed.

As described above, in the method for manufacturing the metal ring laminate according to the present embodiment, the nitriding treatment is performed on the metal ring laminate 10 instead of performing the nitriding treatment on each of the plurality of the metal rings 11. Accordingly, the nitriding treatment apparatus can be reduced in size.

On the other hand, when performing the nitriding treatment on the metal ring laminate 10, the difference between the surface hardness of the metal rings disposed on the surface side of the metal ring laminate and the surface hardness of the metal rings disposed in the middle of the metal ring laminate is prone to occur compared to the case where the nitriding treatment is performed on each of the plurality of the metal rings 11.

Specifically, since the outer circumferential surface 11*a* of the metal ring 11 on the outermost periphery of the metal ring laminate and the inner circumferential surface 11*b* of the metal ring 11 on the innermost periphery of the metal ring laminate are exposed, these metal rings are easily nitrided. On the other hand, the outer circumferential surface 11*a* and the inner circumferential surface 11*b* of the metal ring 11 disposed in the middle of the metal ring laminate 10 are in close contact with the outer circumferential surface 11*a* or the inner circumferential surface 11*b* of the adjacent metal ring 11, and hence hardly any ammonia gas enters the metal rings 11 that are disposed in the middle of the metal ring laminate, and thus these metal rings are hardly nitrided.

Therefore, the nitrided layer 12 is thinner on the outer circumferential surface 11*a* and the inner circumferential surface 11*b* of the metal ring 11 disposed in the middle of the metal ring laminate 10 compared to the nitrided layer 12 on the outer circumferential surface 11*a* of the metal ring 11 on the outermost periphery of the metal ring laminate 10 and on the inner circumferential surface 11*b* of the metal ring 11 on the innermost periphery of the metal ring laminate 10, and thus the surface hardness of the metal ring 11 disposed in the middle of the metal ring laminate 10 is prone to be small.

Further, the surface hardness of the inner circumferential surface 11*b* of the metal ring 11 on the outermost periphery of the metal ring laminate 10 and the surface hardness of the outer circumferential surface 11*a* of the metal ring 11 on the innermost periphery of the metal ring laminate 10 are also prone to be small. Note that the thickness of the nitride layer 12 can be measured through, for example, microstructure observation performed after performing the natal etching. Further, the surface hardness of the metal ring 11 can be measured by, for example, performing the micro-Vickers hardness test.

In the method for manufacturing the metal ring laminate according to the present embodiment, the oxidizing treatment for promoting the nitriding treatment is performed at a temperature equal to or higher than 350° C. and equal to or lower than the aging treatment temperature. By setting the oxidizing treatment temperature at a temperature equal to or higher than 350° C., the difference between the surface hardness of the metal rings 11 of the metal ring laminate 10 can be made small. On the other hand, by setting the oxidizing treatment temperature equal to or lower than the aging treatment temperature, excessive aging can be suppressed, and the strength of the bulk (the non-nitrided part 11*d*) of the metal ring 11 can be maintained at a desired strength.

<Regarding Oxidizing Treatment Temperature>

As described above, in the method for manufacturing the metal ring laminate according to the present embodiment, the oxidizing treatment is performed at a temperature equal to or higher than 350° C. in order to make the difference between the surface hardness of the metal rings 11 of the metal ring laminate 10 small. Hereinbelow, the oxidizing treatment temperature is described.

Figure 6:
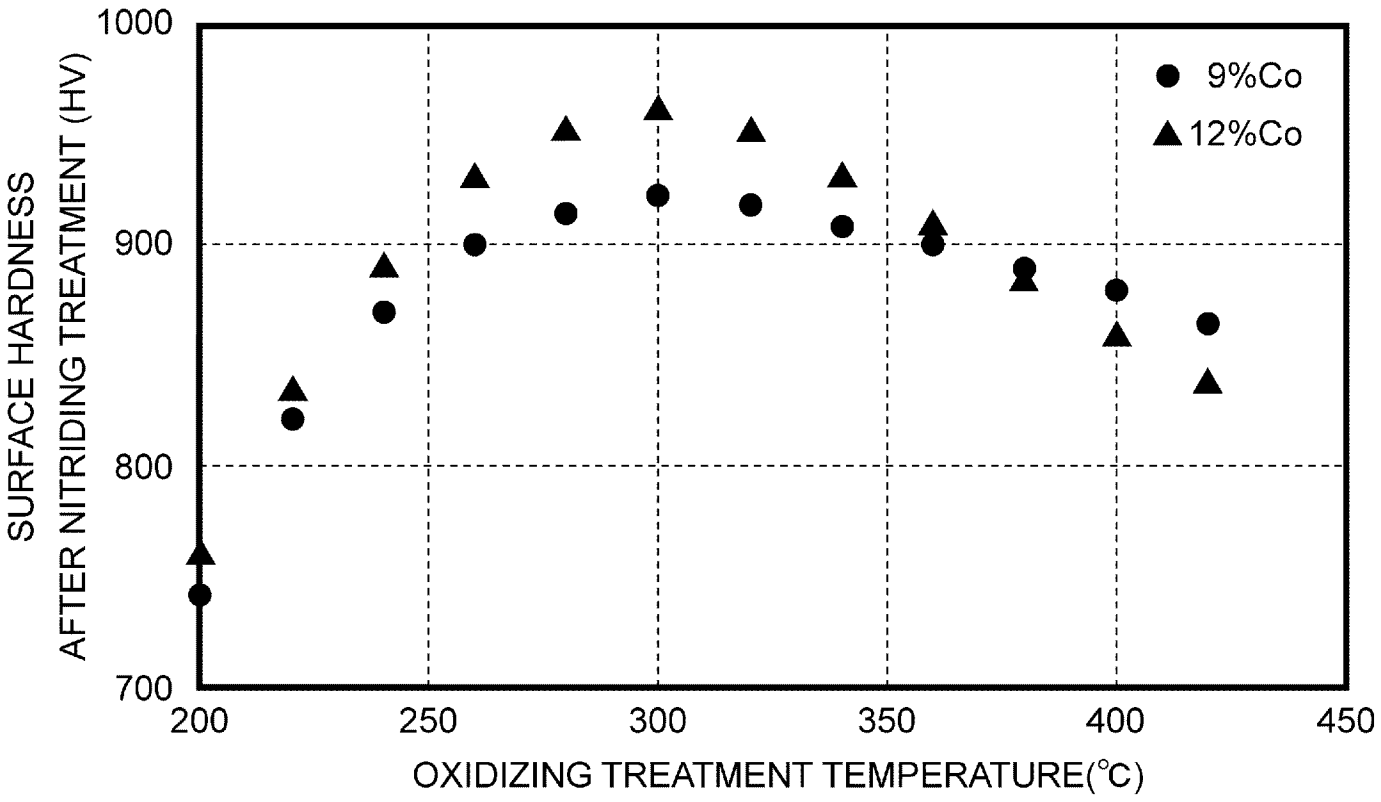
FIG. 6 is a graph showing the oxidizing temperature dependence of the surface hardness of the metal rings of a metal ring laminate that has been nitrided.

FIG. 6 is a graph showing the oxidizing treatment temperature dependence of the surface hardness of the metal rings of the metal ring laminate that has been nitrided. In FIG. 6, the horizontal axis indicates the oxidizing treatment temperature and the vertical axis indicates the surface hardness (HV) of the metal rings of the metal ring laminate that has been nitrided.

As shown in FIG. 6, the oxidizing treatment temperature dependence of the surface hardness of the metal rings 11 made of two types of maraging steel, one metal ring being composed of 9% by mass of Co and the other metal ring being composed of 12% by mass of Co, of the metal ring laminate that has been nitrided was investigated. The composition of the metal ring 11 other than Co is 18% by mass of Ni, 5% by mass of Mo, 0.45% by mass of Ti, and 0.1% by mass of Al, the rest of the parts of the composition being Fe and inevitable impurities. This composition is common to both types of the metal rings 11. The metal rings 11 have a thickness of 0.185 mm and a width of 9.7 mm.

After the oxidizing treatment was performed on the metal rings 11 on which the aging treatment has been performed, the nitriding treatment was performed in the same manner as in the method for manufacturing the metal ring laminate according to the present embodiment.

The aging treatment was performed under an atmosphere of 90% of $N_2$ gas+10% of $H_2$ gas at a temperature of 470° C. for 120 minutes.

The oxidizing treatment was performed under the atmospheric condition for 30 minutes at respective temperatures.

The nitriding treatment was performed under an atmosphere of 90% of $N_2$ gas+10% of $NH_3$ gas at a temperature of 420° C. for 70 minutes.

The surface hardness (HV) of the metal rings 11 of the metal ring laminate that has been nitrided can be measured by performing the micro-Vickers hardness test.

As shown in FIG. 6, both of the metal rings 11, one composed of 9% by mass of Co and the other composed of 12% by mass of Co, of the metal ring laminate that has been nitrided exhibited high peak values in their respective surface hardness at an oxidizing treatment temperature of 300° C. The oxidizing treatment is a pretreatment process for promoting the nitriding treatment, and it is conjectured that when the oxidizing treatment temperature exceeds 300° C., a cobalt oxide is produced whereby the nitriding is hindered.

As shown in FIG. 6, the surface hardness decreased noticeably in the metal ring 11 composed of 12% by mass of Co which contains larger amount of Co compared to the metal ring 11 composed of 9% by mass of Co, when the oxidizing treatment temperature exceeded 300° C.

Next, the surface hardness of the metal rings of the metal ring laminate 10 formed by laminating nine metal rings 11 composed of 12% by mass of Co shown in FIG. 6 was investigated after performing the oxidizing treatment at 300° C., 330° C., 360° C., and 400° C., respectively and then performing the nitriding treatment. Specifically, the surface hardnesses of the outer circumferential surfaces 11*a* of the metal ring 11 on the outermost periphery (the first ring) and the metal ring 11 in the middle (the fifth ring) of the metal ring laminate 10 were investigated. Other conditions of the investigation are as described above.

Here, the metal ring laminates 10 that were oxidized at oxidizing treatment temperatures 300° C. and 330° C., respectively, are comparative examples and the metal ring laminates 10 that were oxidized at oxidizing treatment temperatures 360° C. and 400° C., respectively, are embodiments.

Figure 7:
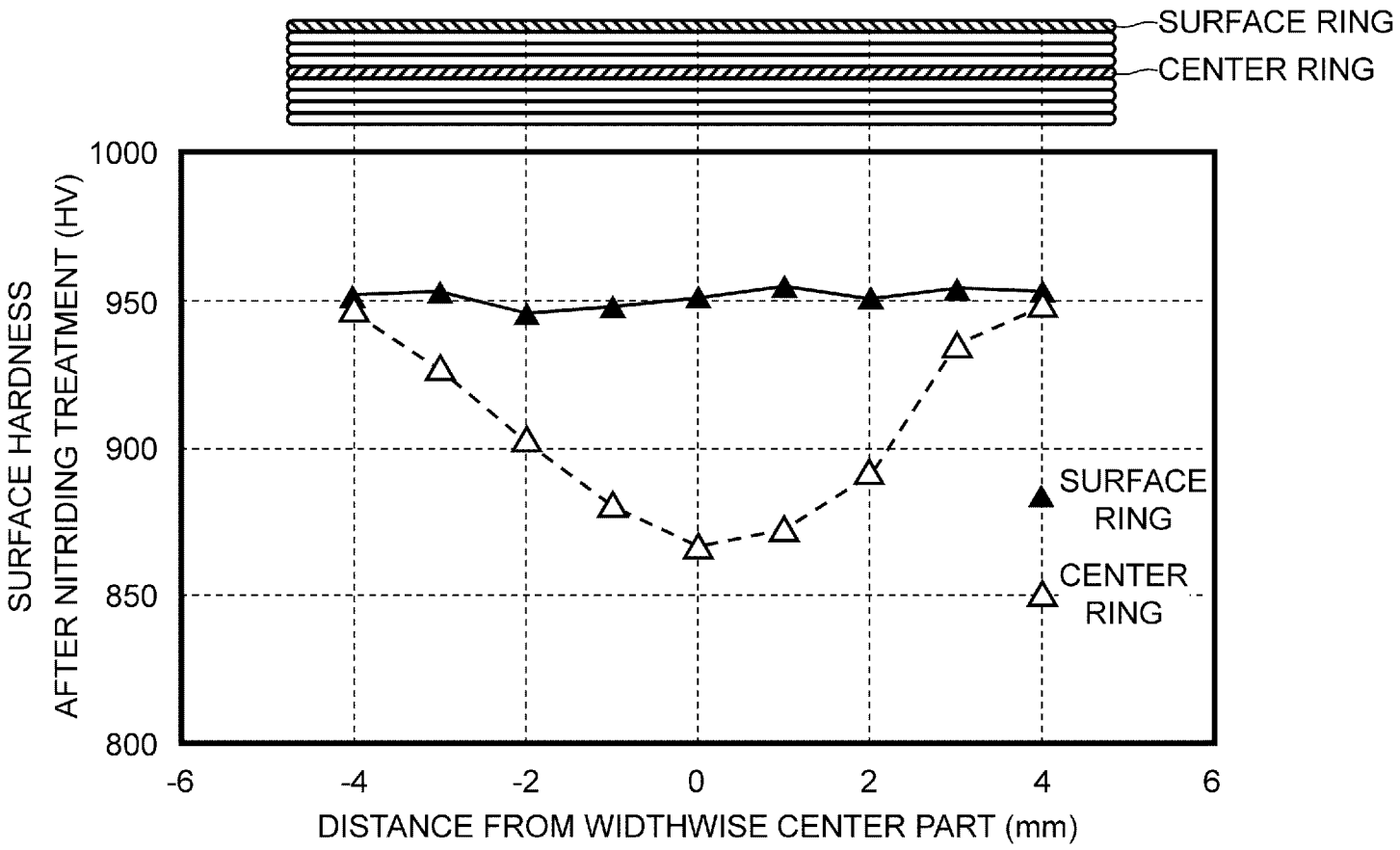
FIG. 7 is a graph showing a change in the surface hardness of the metal rings in the width direction of a metal ring laminate that has been oxidized at a temperature of 300° C.

FIG. 7 is a graph showing a change in the surface hardness of the metal rings in the width direction of the metal ring laminate that has been oxidized at the oxidizing treatment temperature of 300° C.

Figure 8:
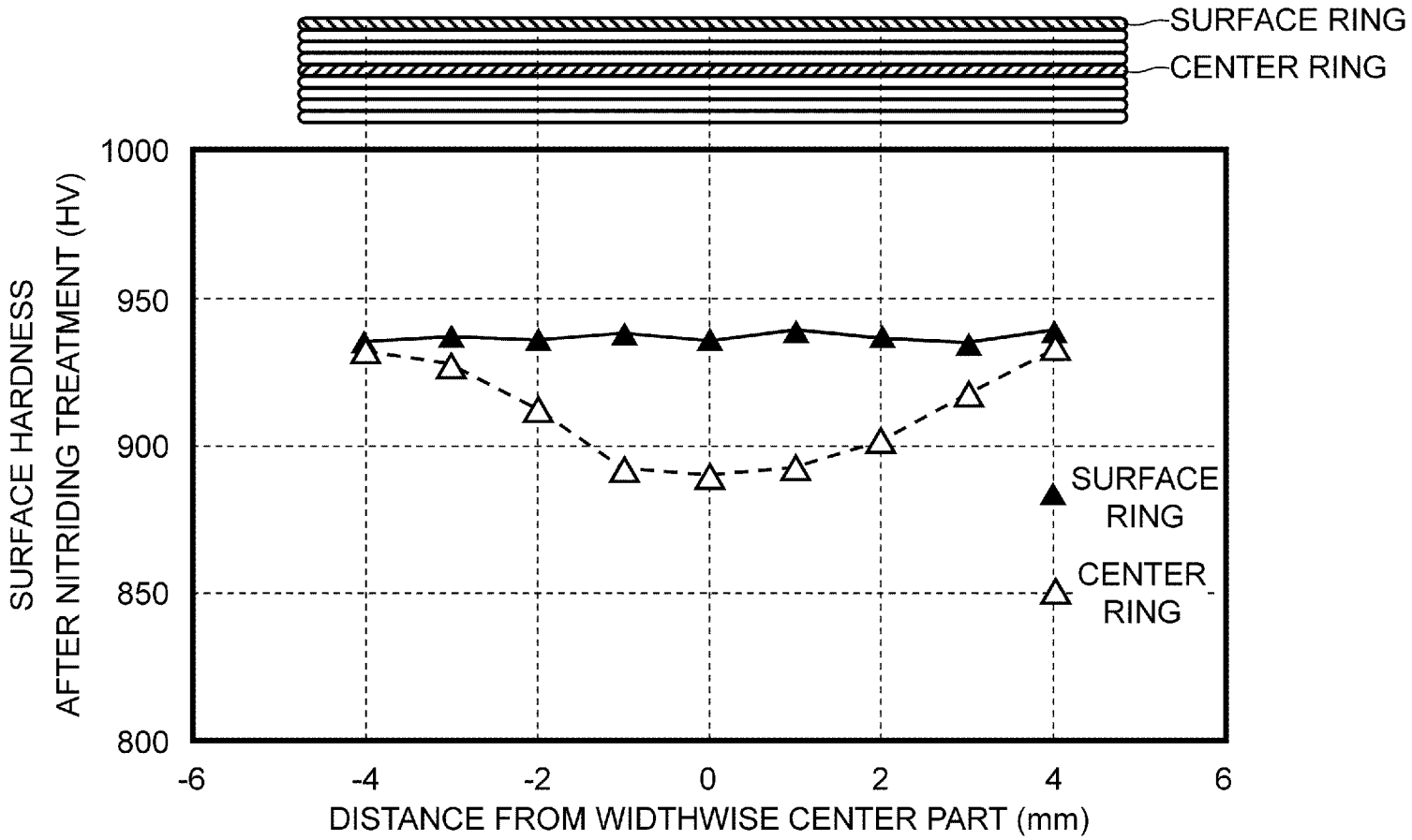
FIG. 8 is a graph showing a change in the surface hardness of the metal rings in the width direction of a metal ring laminate that has been oxidized at a temperature of 330° C.

FIG. 8 is a graph showing a change in the surface hardness of the metal rings in the width direction of a metal ring laminate that has been oxidized at the oxidizing treatment temperature of 330° C.

Figure 9:
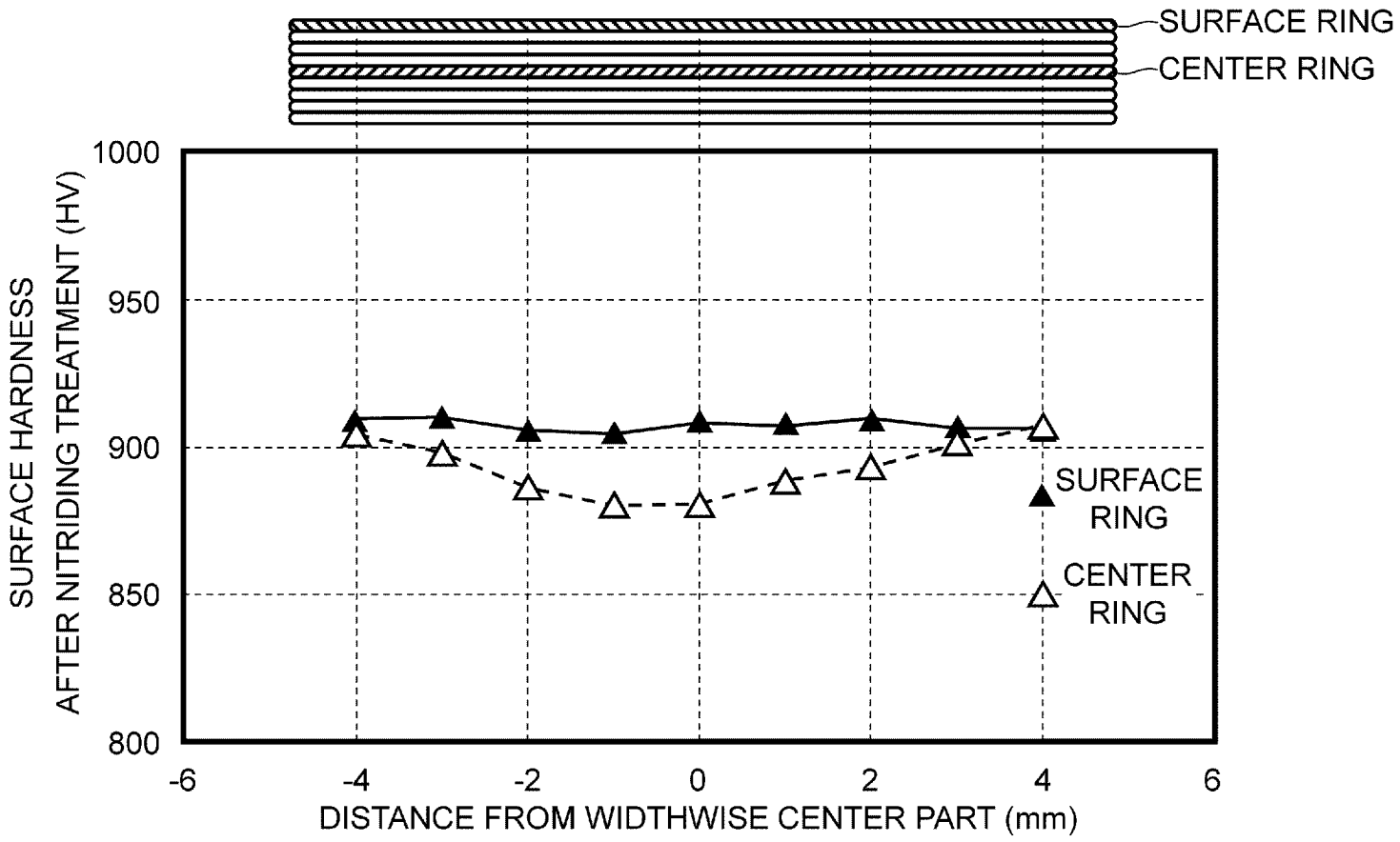
FIG. 9 is a graph showing a change in the surface hardness of the metal rings in the width direction of a metal ring laminate that has been oxidized at a temperature of 360° C.

FIG. 9 is a graph showing a change in the surface hardness of the metal rings in the width direction of a metal ring laminate that has been oxidized at the oxidizing treatment temperature of 360° C.

Figure 10:
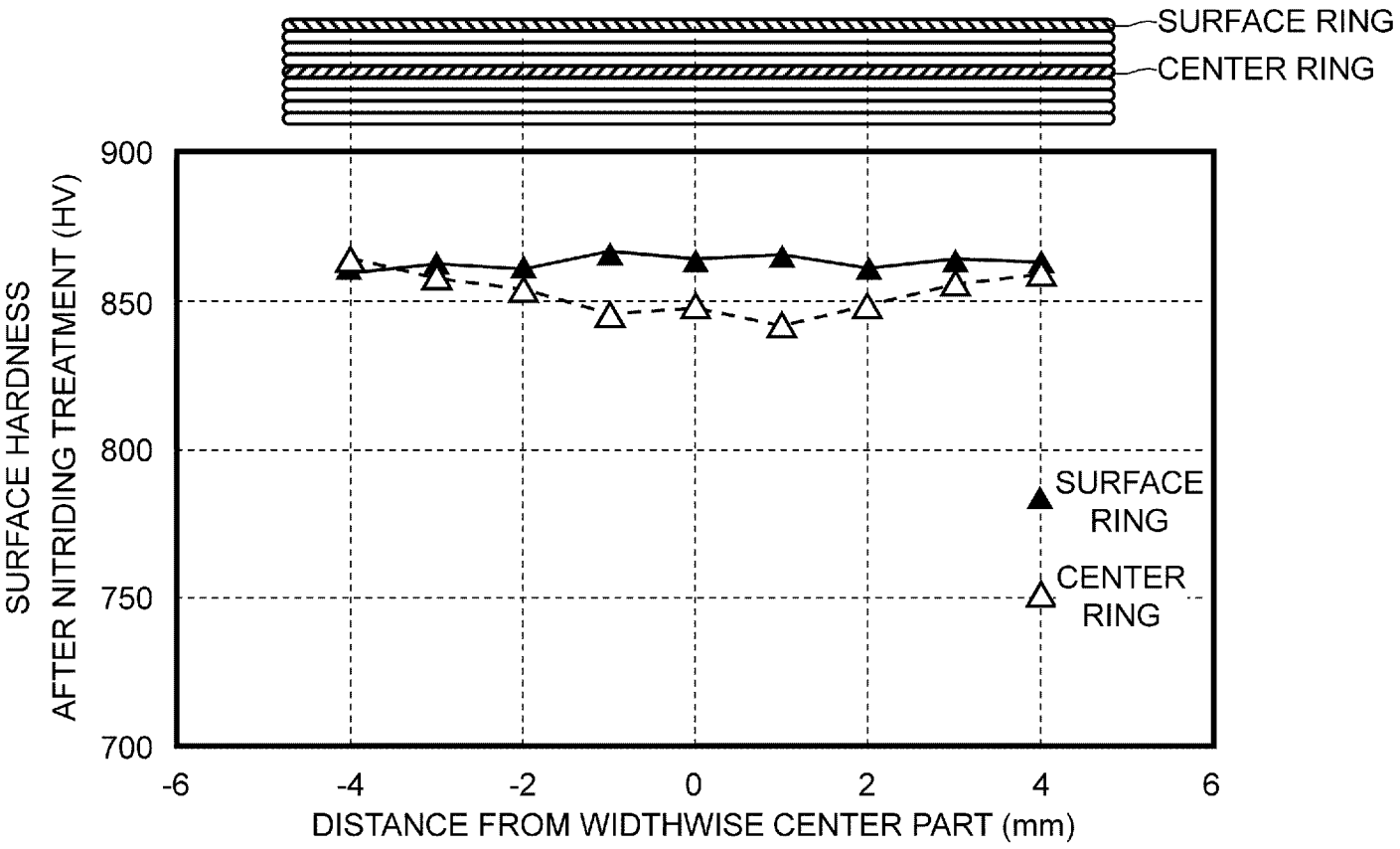
FIG. 10 is a graph showing a change in the surface hardness of the metal rings in the width direction of a metal ring laminate that has been oxidized at a temperature of 400° C.

FIG. 10 is a graph showing a change in the surface hardness of the metal rings in the width direction of a metal ring laminate that has been oxidized at the oxidizing treatment temperature of 400° C.

In FIGS. 7 to 10, the horizontal axes indicate the distance (mm) of the metal rings from the widthwise center part of the metal ring laminate, and the vertical axes indicate the surface hardness (HV) of the metal rings of the metal ring laminate that has been nitrided.

On the uppers side of each of the graphs shown in FIGS. 7 to 10, a sectional diagram of the metal ring laminate 10 is shown. The orientation of the metal ring laminate 10 in the widthwise direction in each of the sectional diagrams coincides with each of the horizontal axes of the graphs shown in FIGS. 7 to 10. In FIGS. 7 to 10, the metal rings 11 on the outermost circumference (referred to as the "surface rings" in the drawings and the description hereinafter) of the metal ring laminate and the metal rings 11 in the middle (referred to as the "middle rings" in the drawings and the description hereinafter) of the metal ring laminate, which are the target of measurement, are indicated by hatching.

As shown in FIGS. 7 to 10, the surface hardness of the surface rings is fixed irrespective of the orientation of the metal ring laminate in the widthwise direction in each of the sectional diagrams shown in FIGS. 7 to 10. Specifically, as shown in FIG. 7, when the oxidizing treatment temperature is 300° C., the surface hardness of the surface rings is fixed at around 950 HV. As shown in FIG. 8, when the oxidizing treatment temperature is 330° C., the surface hardness of the surface rings is fixed at around 940 HV. As shown in FIG. 9, when the oxidizing treatment temperature is 360° C., the surface hardness of the surface rings is fixed at around 910 HV. Further, as shown in FIG. 10, when the oxidizing treatment temperature is 400° C., the surface hardness of the surface rings is fixed at around 870 HV. The surface hardness of each of the surface rings shown in FIGS. 7 to 10 is roughly the same as the surface hardness of the surface ring 11 composed of 12% by mass of Co shown in FIG. 6.

On the other hand, as shown in FIG. 7, when the oxidizing treatment temperature is 300° C., the surface hardness of the center rings is the same as the surface hardness of the surface rings at both widthwise end parts of the metal ring laminate. However, the surface hardness of the rings decreases sharply from both end parts toward the center part of the metal ring laminate. Specifically, the surface hardness decreases from around 950 HV to around 860 HV. That is, the difference between the surface hardness of the surface rings and the surface hardness of the center rings is around 90 HV.

Further, as shown in FIG. 8, when the oxidizing treatment temperature is 330° C., a tendency similar to that exhibited when the oxidizing treatment temperature is 300° C. is observed. Specifically, the surface hardness decreases from around 940 HV to around 890 HV. That is, the difference between the surface hardness of the surface rings and the surface hardness of the center rings is around 50 HV.

On the other hand, as shown in FIG. 9, when the oxidizing treatment temperature is 360° C., the surface hardness of the center rings does not decrease much from the both widthwise end parts toward the center part of the metal ring laminate. Specifically, the surface hardness decreases from around 910 HV to around 880 HV. That is, the difference between the surface hardness of the surface rings and the surface hardness of the center rings is around 30 HV.

Further, as shown in FIG. 10, when the oxidizing treatment temperature is 400° C., the surface hardness of the center rings hardly decreases from the both widthwise end parts toward the center part of the metal ring laminate. Specifically, the surface hardness decreases only from around 870 HV to around 850 HV. That is, the difference between the surface hardness of the surface rings and the surface hardness of the center rings is around 20 HV.

That is, although the surface hardness of the metal rings of the metal ring laminate 10 according to each of the embodiments in which the oxidizing treatment temperatures were 360° C. and 400° C., respectively, decreased, the difference between the surface hardness of the metal rings 11 according to the comparative example could be decreased dramatically to be as small as approximately equal to or lower than 30 HV.

Figure 11:
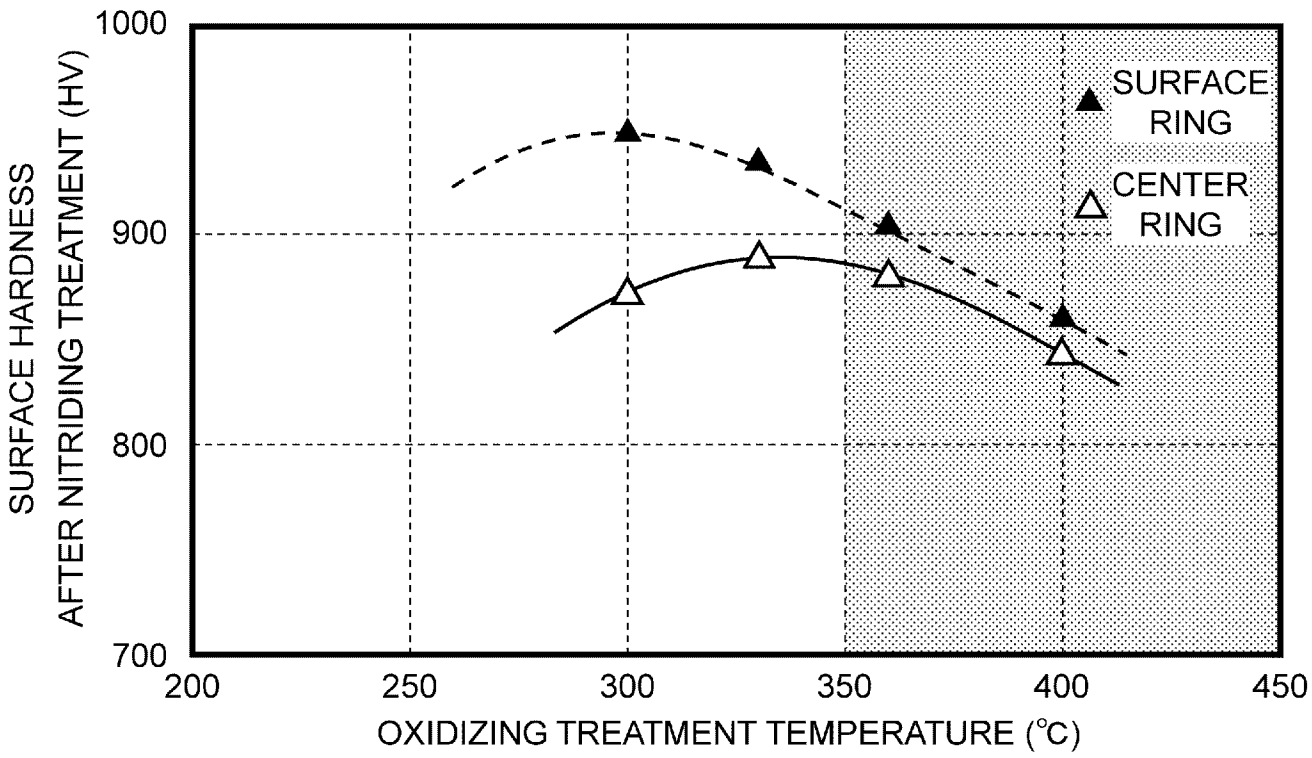
FIG. 11 is a graph showing oxidizing treatment temperature dependence of the surface hardness of surface rings and center rings of the metal ring laminate that has been nitrided.

FIG. 11 is a graph showing oxidizing treatment temperature dependence of the surface hardness of the surface rings and the center rings of the metal ring laminate that has been nitrided. In FIG. 11, the horizontal axis indicates the oxidizing treatment temperature and the vertical axis indicates the surface hardness (HV) of the metal rings of the metal ring laminate that has been nitrided, as in FIG. 6. In the graph shown in FIG. 11, the curve indicating the surface rings is obtained by plotting average values of data (three points) of the surface rings whose "distance from the widthwise center part" of the metal ring laminates shown in FIGS. 7 to 10 is −1 mm, 0 mm, and 1 mm, respectively. As described above, the curve shown in FIG. 11 indicating the surface rings roughly coincides with the curve shown in FIG. 6 indicating the metal rings 11 composed of 12% by mass of Co. In the graph shown in FIG. 11, the curve indicating the center rings is obtained by plotting average values of data (three points) of the center rings whose "distance from the widthwise center part" of the metal ring laminates shown in FIGS. 7 to 10 is −1 mm, 0 mm, and 1 mm respectively.

It is considered that in the metal ring laminate 10, the oxygen concentration at the time of the oxidizing treatment and the ammonia gas concentration at the time of the nitriding treatment are lower in the center rings in the widthwise center part of the metal ring laminate than in the surface rings in the widthwise center part of the metal ring laminate. Therefore, oxidizing that promotes nitriding is less likely to occur in the center rings in the widthwise center part of the metal ring laminate compared to the surface rings in the widthwise center part of the metal ring laminate, and thus it is considered that nitriding is unlikely to occur in the center rings thereafter. Therefore, as shown in FIG. 11, the surface hardness of the center metal rings 11 decreases compared to the metal rings 11 on the outermost circumference of the metal ring laminate that has been nitrided.

Further, since the oxygen concentration is low in the center rings in the widthwise center part of the metal ring laminate compared to the surface rings in the widthwise center part of the metal ring laminate, the oxidizing treatment temperature at which the surface hardness indicates the peak value shifts to a temperature near 330° C. Further, as shown in FIG. 11, when the oxidizing treatment temperature falls in the range of 300° C. to 350° C., the surface hardness of the surface rings decreased sharply whereas the surface hardness of the center rings reaches the peak value.

Therefore, the difference between the surface hardness of the surface rings and the surface hardness of the center rings decreased sharply. Thus, as shown by the dotted area in FIG. 11, by bringing the oxidizing treatment temperature to be equal to or higher than 350° C., the difference between the surface hardness of the metal rings 11 of the metal ring laminate 10 can be made small. Specifically, the difference between the surface hardness of the metal rings 11 of the metal ring laminate 10 can be brought to be approximately equal to or lower than 30 HV.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A method for manufacturing a metal ring laminate comprising:

performing an aging treatment on a metal ring laminate in which a plurality of metal rings made of maraging steel are laminated; and performing a nitriding treatment on the metal ring laminate on which the aging treatment has been performed, wherein an oxidizing treatment is performed after the aging treatment but before the nitriding treatment at a temperature equal to or higher than 350° C. and lower than an aging treatment temperature, and a difference in surface hardness between the plurality of metal rings of the metal ring laminate is 30 HV or less.

2. The method for manufacturing the metal ring laminate according to claim 1, wherein the aging treatment temperature falls in a range of 450° C. to 500° C.

3. The method for manufacturing the metal ring laminate according to claim 1, wherein the metal ring laminate is used for a transmission belt of a continuously variable transmission.

* * * * *